United States Patent [19]

Ross et al.

[11] Patent Number: 4,846,080

[45] Date of Patent: Jul. 11, 1989

[54] APPARATUS FOR REGULATING AIR FLOW THROUGH AN AIR PORT OF A CHEMICAL RECOVERY FURNACE

[75] Inventors: Thomas W. Ross; Robert B. Hill, both of Beaverton, Oreg.; Byron L. Goodspeed, Kelso, Wash.

[73] Assignee: Anthony Ross Company, Beaverton, Oreg.

[21] Appl. No.: 199,139

[22] Filed: May 26, 1988

[51] Int. Cl.[4] ..... F23L 5/00

[52] U.S. Cl. ..... 110/182.5; 110/297; 266/266; 431/188

[58] Field of Search ..... 110/297, 309, 310, 314, 110/182.5; 431/121, 122, 123, 188; 266/265, 266, 269; 15/246

[56] References Cited

U.S. PATENT DOCUMENTS

| | | | |
|---|---|---|---|
| 2,699,796 | 1/1955 | Grindle et al. | 110/182.5 X |
| 3,943,861 | 3/1976 | Astrom et al. | 110/182.5 |
| 4,666,270 | 5/1987 | Hager | 126/285 A |
| 4,759,299 | 7/1988 | Kennedy et al. | 110/182.5 X |

*Primary Examiner*—Edward G. Favors
*Attorney, Agent, or Firm*—Dellett, Smith-Hill & Bedell

[57] ABSTRACT

Removable apparatus for regulating air flow through an air port in a chemical recovery furnace. A plenum mounted adjacent an air port inside a wind box associated with the furnace supplies combustion air from the wind box to the furnace through the air port, and an adjustable damper mounted inside the plenum regulates the velocity and quantity of air flowing through the plenum. An access port in the plenum allows viewing of the air port opening through the plenum. An actuating mechanism withdraws the damper from the field of view to a retracted position wherein the damper depends from the top of the plenum chamber spaced apart from the air port opening. For airflow damping, the actuating mechanism moves the retracted damper toward the air port opening until the damper is adjacent to the opening; then a positioning mechanism pivots the damper to a predetermined position in the air stream adjacent the opening. The damper positioning mechanism comprises a spring loaded cylinder that holds the damper by spring tension, when retracted, above the flow of air through the plenum chamber. Upon further compression of the cylinder by the actuating mechanism, the reduced length of the compressed cylinder forces the damper downward into the air stream. When the actuating mechanism is reversed, the spring tension of the compressed cylinder pulls the damper upward to the retracted position.

7 Claims, 4 Drawing Sheets

APPARATUS FOR REGULATING AIR FLOW THROUGH AN AIR PORT OF A CHEMICAL RECOVERY FURNACE

BACKGROUND OF THE INVENTION

The present invention relates to furnaces and particularly to improved apparatus for regulating air flow through a port introducing combustion air into the firebox of a furnace.

Wood pulp for papermaking is usually manufactured according to the sulfate process wherein wood chips are treated with a cooking liquor including sodium sulfide and sodium hydroxide. The wood chips and the cooking liquor, called "white liquor", are cooked in a digester under predetermined heat and temperature conditions. After cooking, the used liquor, termed "black liquor", containing spent cooking chemicals and soluble residue from the cook, is washed out of the pulp and treated in a recovery unit where the cooking chemicals are reclaimed. Without reclamation and reuse of the cooking chemicals, the cost of the papermaking process would be prohibitive.

In the recovery process, the black liquor is first concentrated by evaporation to a water solution containing about 65 percent solids, which solution is then sprayed into the firebox of a black liquor recovery boiler, a type of chemical reduction furnace. The chemical reduction furnace is a reactor wherein the processes of evaporation, gasification, pyrolysis, oxidation and reduction all occur interdependently during recovery of the cooking chemicals. The organic materials n the black liquor, lignin and other wood extracts, maintain combustion in the firebox, and the heat produced dries and melts the spent cooking chemicals as they fall to the floor of the firebox, where they build a mound of material called a char bed. The char bed is further heated to further liquefy the chemicals into a molten smelt that flows out of the furnace through a smelt spout to a collection tank. Concurrently, combustion heat is employed to generate steam in a water wall of the boiler for use as process steam and for generating electricity.

The combustion process requires the introduction of large volumes of air into the firebox, air comprising about 80 percent of the material entering the furnace. The combustion air is distributed by means of wind boxes or ducts disposed at several levels in surrounding relation to the firebox and outside the walls of the furnace. The air is forced into the firebox from the wind boxes through a plurality of passages or air ports in the walls of the furnace, viz.: primary, secondary and tertiary air ports. The primary air ports, through which about 40 to 50 percent of the air enters the furnace, are disposed on the side walls of the firebox near the bottom of the furnace and close to the char bed. The air supplied to the primary air ports is at a comparatively low pressure in order to promote a reducing atmosphere in the burning mass of char. The secondary air ports, which are fewer in number than the primary air ports and through which about 35 percent of the air enters the furnace, are disposed around the walls of the firebox, higher than the primary air ports, and usually below the level of the entry conduits through which the black liquor is sprayed into the firebox. Air supplied through the secondary air ports is at a slightly higher pressure in order to promote burning of combustible gasses rising from the glowing mass of the char bed. While the primary air ports provide a relatively large volume of air with considerable turbulence for maintaining a fireball in the char bed, the secondary air ports are intended to provide a finer control and distribution of air above the char bed and distribute the air evenly in the black liquor spray to support the combustion thereof. Air is supplied through the tertiary air ports at a still higher pressure to promote combustion of gases rising through the firebox, the tertiary air ports being higher on the wall of the furnace than the secondary air ports.

The black liquor sprayed into the firebox, having a consistency like warm 60 weight oil, swirls, burns and falls toward the bottom of the firebox in the form of combustion products comprising char material and smelt. The smelt and char material contact and flow down the outer walls of the firebox and, cooled by the inflowing air, form excrescent deposits around edges of the air ports, particularly along the top edges of the secondary air ports where the excrescent material builds up and outward under influence of air rushing through the secondary air port. Such buildup of char material can block air flow through a port by as much as ten percent. Therefore, furnace operation tends to be inefficient and unpredictable with an attendant decrease in the amount of chemicals that can be recovered, a decrease in the amount of steam produced per unit of fuel, and increased emission of noxious gases such as hydrogen sulfide, carbon monoxide and sulfur dioxide. In accordance with customary practice, the char buildup is periodically removed either by manually inserting a cleaning rod into the air ports successively around the boiler or by actuating mechanized cleaning apparatus mounted in the air ports. With the passage of time, and particularly when cleaning is effected by manual rodding of the air ports, gradual buildup of char material intermittently around the furnace can cause changes in the volume of combustion air, as well as changes in air distribution, velocity and pressure.

The volume and distribution of combustion air supplied to the furnace will also vary depending on the load of the furnace and the moisture content of the liquor being reduced. The distribution and volume of air entering a furnace is conveniently adjusted by regulating means such as dampers provided in supply conduits of the wind boxes. Dampers may also be provided at various locations in the wind boxes, and individual air ports may furthermore be provided with a damper, thus making possible a selective distribution of air within each wind box, or in each wind-box passage or each air port, respectively, thereby maintaining the desired air supply in all parts of the furnace.

Viewing and access ports are provided in the wind box adjacent to the air ports of recovery furnaces. Monitoring devices such as pyrometers for sensing temperature inside the firebox and television cameras for viewing conditions in the furnace are often installed in such access ports. A damper installed in the air port may block the view through the viewing port or interfere with the operation of sensors, and it has been necessary in the past to remove the damper before installing a sensor.

Separate apparatus for cleaning openings in a recovery furnace are known. See, for example, U.S. Pat. No. 4,423,533 entitled FURNACE AIR PORT CLEANER. Apparatus combining the function of air-port cleaning and air-flow damping are also known, e.g., see copending U.S. patent application Ser. No. 829,712 filed Feb. 13, 1986 by Byron L. Goodspeed and entitled APPARATUS FOR CLEANING AIR PORTS OF A CHEMICAL RECOVERY FURNACE, now U.S. Pat. No. 4,748,004; and copending U.S. patent application Ser. No. 199,126 filed concurrently herewith by Byron L. Goodspeed, entitled APPARATUS FOR REGULATING AIR FLOW THROUGH AN AIR PORT OF A CHEMICAL RECOVERY FURNACE. Dual purpose apparatus such as disclosed in the first-mentioned copending application have been found to have some disadvantages in either the air damping or the cleaning. Cleaning apparatus designed to be effective for that purpose, when used as a damper, may be subjected to excessive heat from the furnace and deteriorate rapidly. The aforementioned Goodspeed '712 application discloses a cleaning head for use in secondary air ports that may be employed also as a damper to control the flow of combustion air through the air port. For this purpose, the cage-like structure of the cleaning head is enclosed, and the mounting frame is partially or completely enclosed or walled in, so that, for a given position of the cleaning head, air flow tends to be closed off. The position of the cleaning head may be varied to accomplish cleaning or to effect a different air flow. It has been found that a cleaning element utilized as a damper partially or fully blocking an air port, i.e., extending into the air port, often is subjected to excessive heat from the furnace. It is thus sometimes desirable to employ a separate damper that is disposed near but spaced apart some distance inside the wind box from the air-port opening.

On the other hand, a device designed to function effectively as a damper, when extended into the air port for cleaning the same, often proves to be less effective for that purpose because the shape of the damper is not always conducive to cleaning the opening. Accordingly, separate air damping and air-port cleaning apparatus are desirable over dual purpose devices because more uniform and stable air flow is maintained through the air ports, resulting in more efficient operation of the furnace.

A damper that controls the air flow to a particular air port ordinarily is located near the air port, toward the top of the opening, and consequently may interfere with the operation of separate automatic cleaning apparatus installed in the air port. If unlimited space were available, a damper could be installed upstream of the cleaning apparatus in the passage supplying air to the air port; however, space adjacent to an air port for installing such apparatus is often limited and constructing such additional space is costly. Further, when a damper is retracted or moved out of the way of cleaning apparatus, it is often necessary to position the damper such that air flow through the passage to the air port is blocked, which is undesirable because without positive air pressure outside the air port, effluent from the furnace could enter the air duct and foul or damage the mechanisms. A retracted damper that blocks the flow of air to the air port can also block the view of an observer attempting to view the furnace through a viewing port associated with the air port opening.

It is accordingly a primary object of the present invention to provide improved apparatus for regulating the flow of combustion air in a chemical recovery furnace.

It is a more particular object of the present invention to provide improved air regulating apparatus installable in an air port of a chemical recovery furnace and including a damper mechanism that operates cooperatively with air-port cleaning apparatus.

Another object of the present invention is to provide improved air regulating apparatus for increasing the operational stability of a black liquor recovery boiler.

It is another object of the present invention to provide improved apparatus installable in an air port of a chemical recovery furnace for regulating air flow through the air port, which apparatus can be retracted without interfering with the operation of a sensing device associated with the air port in which the air flow regulating apparatus is installed.

Yet another object of the present invention is to provide improved apparatus installable in an air port of a chemical recovery furnace for regulating the flow of combustion air through the air port, which apparatus is retractable without blocking air flow through the air port.

It is a further object of the present invention to provide improved apparatus regulating air flow through an air port of the furnace of a black liquor recovery boiler for enhancing the efficiency of chemical recovery, increasing steam production, and reducing emissions of sulfur dioxide and carbon monoxide.

SUMMARY OF THE INVENTION

According to the present invention, in a preferred embodiment thereof, a furnace air port is provided with apparatus including a plenum chamber with an adjustable damper mounted therein. Means are provided for retracting the damper to a position spaced away from the air port opening and out of the way of other devices such as cleaning apparatus and sensors. When retracted, the damper is removed from the sight between an access port and the air port opening. An actuating mechanism moves the retracted damper toward the air port opening until the damper is adjacent to the opening; then a positioning mechanism pivots the damper to a predetermined position in the air stream adjacent to the opening.

The positioning mechanism comprises a spring loaded cylinder that holds the damper by spring compression, when retracted, above the flow of air through the plenum chamber. Upon further compression of the cylinder by the actuating mechanism, the damper is forced down into the air stream mechanically by the reduced length of the compressed cylinder. When the actuating mechanism is reversed, the force of the compressed spring pulls the damper upward to the retracted position.

The apparatus according to the present invention is easily removable from the air port, for example, to service or repair the damper. The damper mechanism is affixed to a plate which is removably attached to a flange on the external wall of the wind box. The plate and the damper mechanism attached thereto are thus easily removed from the wind box.

The apparatus according to the instant invention is suitably operated at regular intervals on an automatically timed basis in concert with other apparatus such as a cleaning device installed in the air port so as to keep the air port substantially clear of excrescent material and without interfering with air flow damping, which results in improved stability of furnace operation. Consequently, more efficient recovery of chemicals is realized, as well as an increase in steam production and decrease in the emission of pollutant gasses. While only a single apparatus according to the present invention is illustrated and described herein, it is understood that a plurality of such apparatus are ordinarily disposed around a particular firebox so as to regulate the air flow through a comparatively large number of air inlets. The separate apparatus can be operated either sequentially or simultaneously.

DRAWINGS

While the invention is set forth with particularity in the appended claims, other objects, features, the organization and method of operation of the invention will become more apparent, and the invention will best be understood, by referring to the following detailed description in conjunction with the accompanying drawings, in which:

Figure 7:
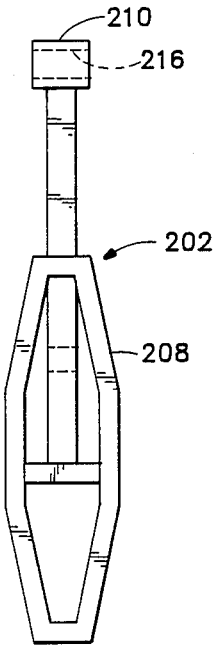
Figure 8:
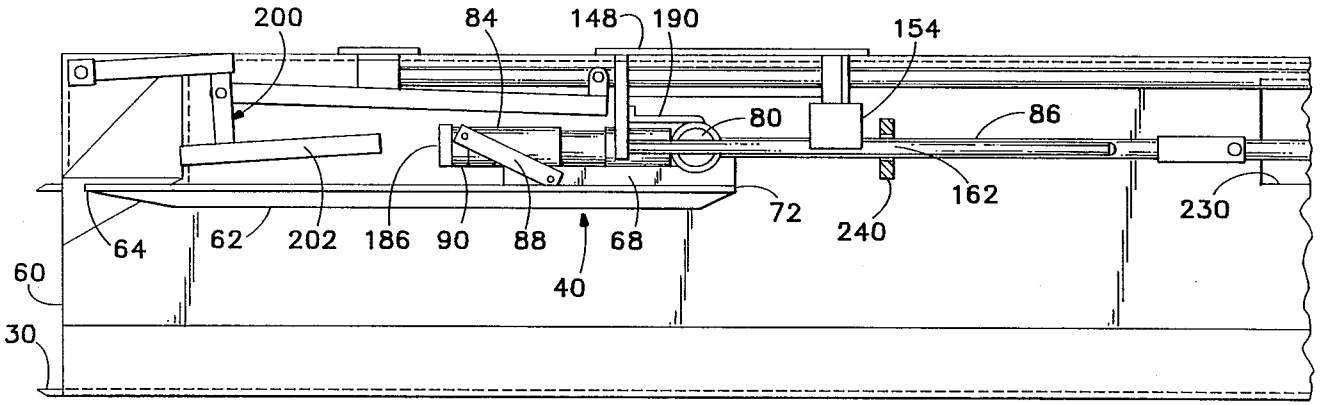
Figure 9:
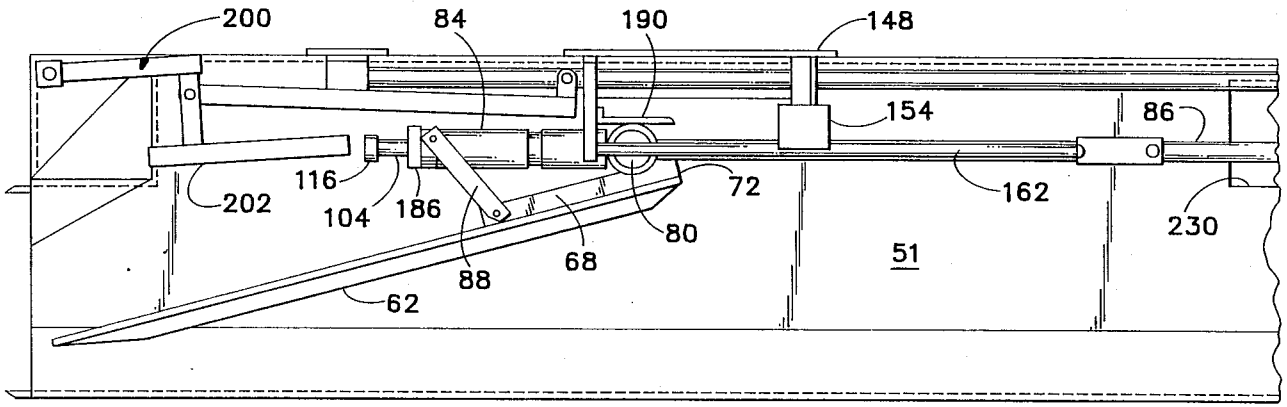

FIG. 7 in an end view of cleaning apparatus utilized with the present invention;

FIG. 8 is a side elevation view, partially cut away, of apparatus according to the instant invention, and showing a damper in a full-open position; and FIG. 9 is a side elevation view, partially cut away, of apparatus according to the instant invention, and showing a damper in a fully-closed position.

DESCRIPTION OF THE PREFERRED EMBODIMENT

Figure 1:
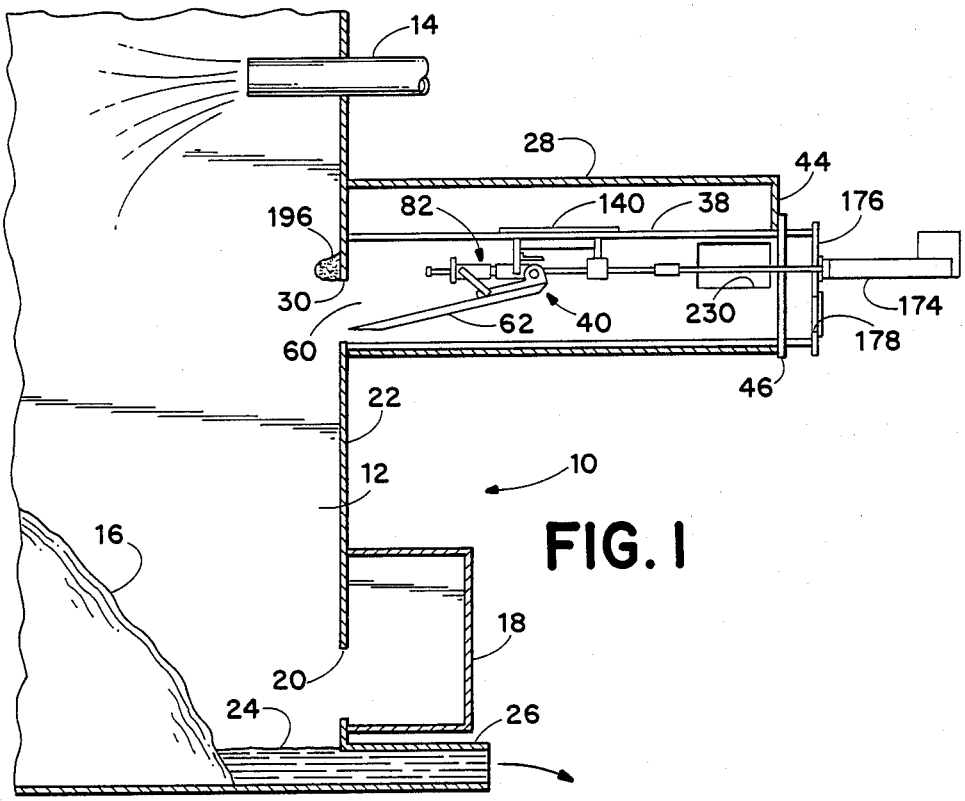
FIG. 1 is a schematic view of a portion of a black liquor recovery boiler with which the present invention may be employed, and showing one embodiment of the invention installed therein.

Referring now to the various views of the drawing for a more detailed description of the construction, function, operation and other features of the instant invention by characters of reference, FIG. 1 shows a black liquor recovery boiler 10 which comprises a firebox 12 of a steam boiler. Black liquor sprays from a conduit 14 into the firebox 12, where the organic materials in the black liquor ignite, the resulting chemicals and combustion products falling to the floor of the firebox as a char bed 16. A first wind box 18 substantially surrounds the firebox 12 and delivers combustion air under pressure into the firebox through a plurality of primary air ports 20 formed in the wall 22 of the firebox 12 around the periphery thereof at the level of the char bed 16 to maintain a fireball in the char bed. Molten chemical-containing smelt 24 drains from the burning char bed 16 through smelt spouts 26 disposed in the bottom of the firebox 12, and collects in vessels (not shown) for further treatment.

A second wind box 28 substantially surrounds the firebox 12 and delivers combustion air under pressure into the firebox through a plurality of secondary air ports such as air port 30 formed in the wall 22 of the firebox 12 around the periphery thereof above the char bed 16 and below the level of the black liquor entry conduit 14 for supporting the initial combustion of the organic materials in the black liquor.

Figure 2:
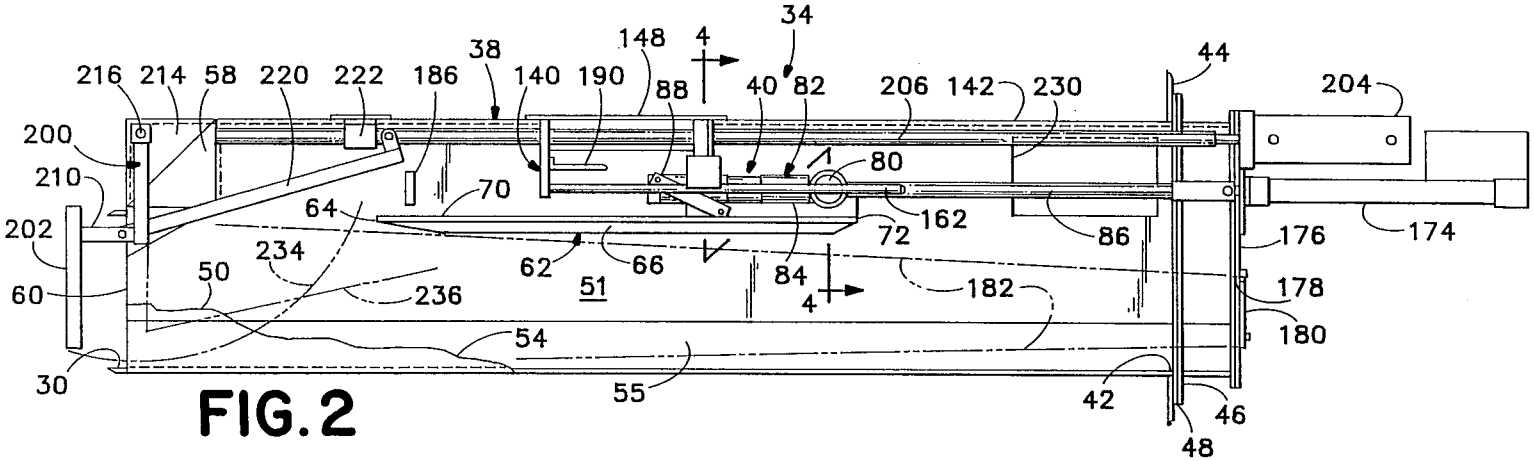
FIG. 2 is a side elevation view, partially cut away, of apparatus according to the instant invention, and showing a damper in a retracted position.

Referring now to FIGS. 1 and 2, in accordance with the present invention, apparatus 34 installed in the second wind box 28 for regulating the flow of air into the air port 30 comprises a plenum chamber 38 in which an adjustable damper assembly 40 mounts for adjustably attenuating the flow of air through the plenum chamber 38 to the air port 30. The plenum chamber 38 fits through a cutout 42 in the outer wall 44 of the wind box and attaches to the wind box by suitable fasteners (not shown) through a mounting frame 46 affixed to the plenum chamber, which fastens to a flange 48 welded to the wall 44 of the wind box. The plenum chamber 38 is constructed of sheet metal in the form of an enclosed, generally rectangular duct having parallel side walls 50, 51 spaced apart by a distance substantially the same as the width of the air port 30. The dimensions of the plenum chamber 38 can vary according to the size and shape of the air port 30 and the space available in the wind box. Air ports of chemical reduction furnaces are generally rectangular in shape; however, the shape may vary. For example, referring to FIGS. 2 and 6, the air port 30 for which the apparatus 34 of the presently described embodiment of the invention was constructed is a modified, truncated diamond-shape opening approximately 26 centimeters high and 8.3 centimeters wide at a center region, tapering to a width of 3.8 centimeters at the top and bottom of the air port 30 opening. Higher than the air port opening 30 by approximately one-third, the plenum chamber includes a region above the air port to accommodate the adjustable damper assembly and other apparatus as described hereinafter. Lower side walls 54, 55 of the plenum chamber 38 taper inwardly toward the bottom of the plenum chamber, and the upper end wall 58 adjacent the air port forms an opening 60 substantially the size of the air port 30. The near side wall 50 of the plenum chamber 38, as viewed in FIGS. 1, 2, 7 and 8 is shown cut away to reveal the apparatus inside the plenum chamber.

Referring to FIGS. 2–4, 8 and 9, the adjustable damper assembly 40 comprises an oblong, flat blade 62 made of sheet metal and having a width slightly less than the interior width of the plenum chamber 38. In the presently described embodiment of the invention, the damper blade 62 is 85 centimeters long, 4 millimeters thick, and 9 centimeters wide, a distal end 64 of the blade tapering to a width of 5 centimeters. A stiffening member 66 suitably made of steel bar stock and welded longitudinally and centrally disposed beneath the damper blade 62 supports and stiffens the blade 62. Each of a pair of attachment members 68, 69 affixed longitudinally in mutually parallel relation to the upper surface 70 of the damper blade 62 at a proximal end 72 thereof includes an upwardly projecting lug 74, 75 having a circular aperture 76, 77 therethrough. The lugs 74, 75 form a clevis through which a slidable pivot 80 extends, the damper blade 62 depending rotatably from the pivot 80.

A damper positioning mechanism 82 comprises a telescoping cylinder 84 which abuts the pivot 80, and an actuating rod 86 extending through the pivot 80 and coaxially through the cylinder 84. A pair of connecting arms 88, 89 disposed on either side of the telescoping cylinder 84 hold the damper blade 62 cantilevered from the pivot 80. The connecting arms 88, 89, each attach pivotally at one end thereof to a bearing block 90 of the cylinder 84 by a pin 91, and at the other end to the respective attachment members 68, 69 of the damper blade 62. The pivot 80, which is suitably made from cylindrical bronze stock, includes a central bore 92 having an axis parallel with the longitudinal axis of the damper blade, through which bore 92 the actuating rod extends. A counterbore 94 in the pivot 80 receives a shoulder or step 96 of increased diameter of the actuating rod 86, while a second counterbore 98 opposite the first counterbore 94 in the pivot 80 receives therein an end bearing 100 of the telescoping cylinder 84. The end bearing 100, which is suitably made from cylindrical brass stock, includes a central bore 102 through which the actuating rod 86 extends. A threaded rod 104 inserted into a counterbore 106 extends axially from the end of the actuating rod 86, and a roll pin 108 driven through lateral apertures drilled through the rods 86, 104 retains the threaded rod 104 in the actuating rod 86. A cylindrical compression bearing 110, which is suitably machined from stainless steel, includes a centrally disposed internally threaded section 112, a counterbore 114 and a flange 116 at the distal end thereof. The flange 116 includes parallel flats (not shown) machined on opposite sides thereof, the flats facilitating application of a wrench to the flange 116 for threading the cylindrical compression bearing 110 onto the rod extension 104. A cylindrical bronze bushing 118 pressed into a counterbore in the flange 116 receives a machined rod end 120 of the threaded rod extension 104 into a central bore 122 of the bushing 118. The positioning cylinder houses a compressed coil spring 124 coaxially with and surrounding the rod 86 between the bearing block 90 and the end bearing 100. A housing 126, which is suitably made from stainless steel tubing, encloses the coil spring 124 and comprises a first cylinder 128 affixed to the end bearing 100 and a second cylinder 130, which telescopes inside the first cylinder 128. The second cylinder 130 slips onto a cylindrical boss 131 machined in the bearing block 90, and a suitable fastener such as a set screw (not shown) holds the cylinder 130 in place thereon.

Figure 3:
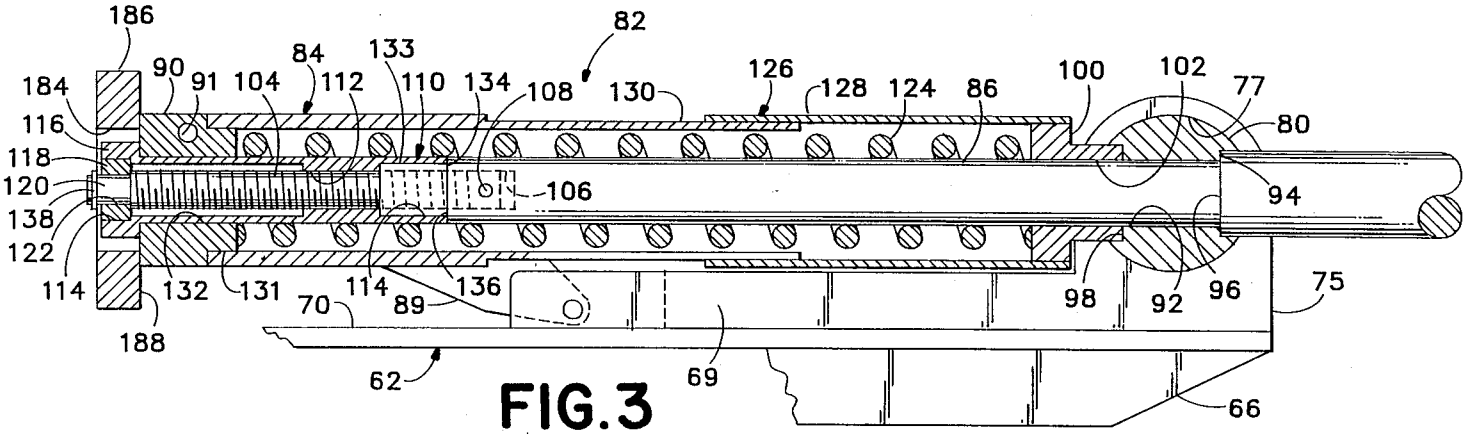
FIG. 3 is a section view of the damper positioning mechanism of FIG. 2.

The construction of the actuating rod 86 with the threaded rod extension 104 and the compression bearing 110 facilitate assembly of the damper positioning cylinder 84 for operation by sliding the pivot 80, the end bearing 100 with the cylinder 128 and the coil spring onto the actuating rod 86. The uncompressed coil spring 124 extends beyond the end 120 of the threaded rod extension 104. The telescoping cylinder 130 is then slipped onto the coil spring 124, and the compression bearing 110 is inserted through a central aperture 132 of the bearing block 90 and threaded onto the threaded rod extension 104. As the threaded section 112 of the compression bearing 110 turns onto the rod extension 104 the flange 116 bears on the bearing block 90 and compresses the coil spring 124 longitudinally. Threading of the compression bearing 110 onto the rod extension 104 continues until a machined end 133 of reduced diameter of the actuating rod 86 seats in the counterbore 114 of the compression bearing 110 and an end 134 of the bearing 110 abuts a shoulder 136 of the rod 86, at which point the rod end 120 protrudes slightly from the bushing 118 at the distal end of the compression bearing 110. A retaining ring 138 inserted into a peripheral groove machined into the rod end 120 prevents the compression bearing 110 from unthreading. With the damper positioning mechanism in its assembled and retracted configuration as shown in FIGS. 2, 3 and 8, the force of the compressed coil spring 124, acting through the connecting arms 88, 89, holds the damper blade 62 cantilevered in a horizontal position.

Figure 4:
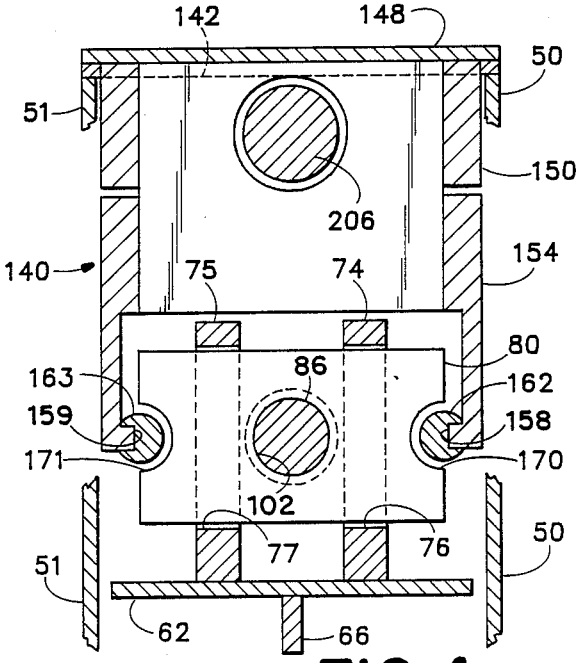
FIG. 4 is a modified section view taken along lines 4—4 of FIG. 2.
Figures 5, 6:
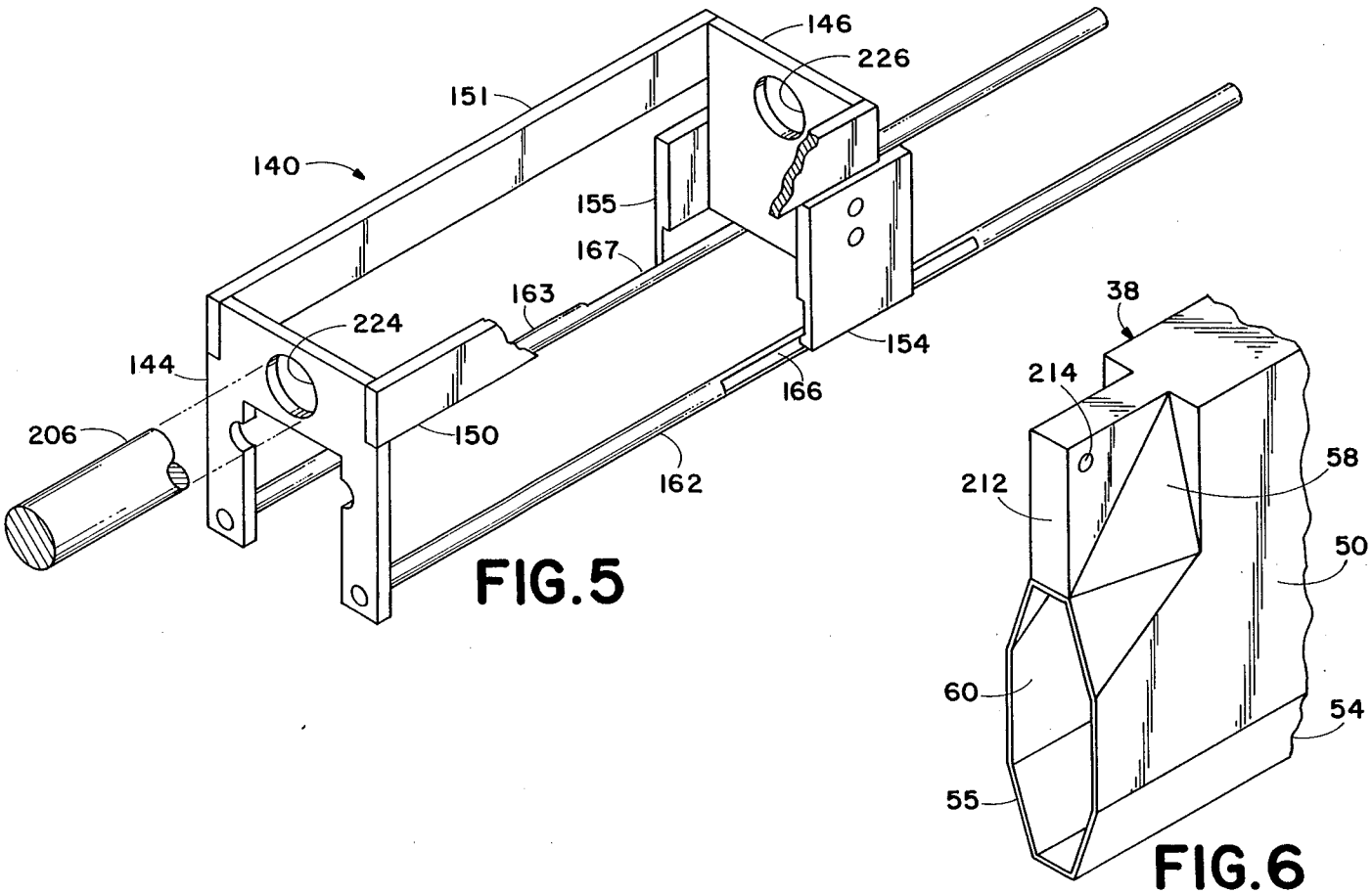
FIG. 5 is a cutaway perspective view of a mounting means for the damper positioning mechanism.
FIG. 6 is a perspective view of a portion of a plenum chamber in accordance with the present invention showing the air port opening.

Referring to FIGS. 2, 4 and 5, a mounting assembly 140 attached to the top 142 of the plenum chamber 38 holds the adjustable damper assembly 40 suspended inside the plenum chamber 38, the mounting assembly 140 being removable through an aperture in the top 142. Forward and rearward support plates 144, 146 affixed beneath a suspension plate 148 depend therefrom into the plenum chamber 38. Suitable fasteners such as machine screws (not shown) hold the suspension plate 148 affixed to the top 142 of the plenum chamber 38. Longitudinal stiffening members 150, 151 welded to the suspension plate 148 attach at either end thereof to the forward and rearward plates 144, 146 by suitable fastening means such as machine screws. Lateral support plates 154, 155 attach to and depend from either side of the rearward plate 146, each of the plates 144, 146 having a longitudinally extending key 158, 159 machined into the interiorly facing surface at the extended ends of the plates 144, 146. A pair of longitudinally extending cylindrical rails or tracks 162, 163 having keyways 166, 167 machined therein attach, respectively, to the support plates 154, 155 by suitable fastening means such as threaded machine bolts, the keyways 166, 167 receiving the keys 158, 159 therein. The forward end of each of the rails 162, 163 seats into an aperture drilled in the forward support plate 144, while the opposite end extends rearward in cantilevered fashion from the respective lateral support plate 154, 155. The rails 162, 163 are slidably received in respective longitudinal channels 170, 171 machined into either side of the pivot 80, thereby supporting the adjustable damper assembly 40 in longitudinal translation responsive to movement of the actuating rod 86.

Referring to FIGS. 2, 8 and 9, the actuating rod 86 extends from a damper actuator 174 mounted outside the plenum chamber 38 on a faceplate 176 of the plenum chamber, the rod 86 passing through an aperture in the faceplate. The actuator 174 may be a motor driven worm drive or any other controllable motive means for advancing the actuating rod 86 longitudinally into the plenum chamber and likewise withdrawing it.

An access port 178 in the faceplate 176 includes a closure 180, which may be, for example, a glass plate providing a view or "sight" through the plenum chamber to the opening 60, the sight defined by dashed lines 182. Alternatively, the access port 178 may be utilized to install a sensing device such as a temperature probe in the plenum chamber, or to mount monitoring apparatus such as a television camera for viewing the air port opening, the damper mechanism or cleaning apparatus installed in the plenum chamber. A "sight" means herein a region between an access port and an air port defined by line-of-sight peripheries of the access port and the air port opening, which region may be utilized for visual observation of the air port from the access port and/or for installation of apparatus sensing data pertaining to the air port opening. It is desirable that the sight through a plenum chamber be unobstructed, or alternatively that apparatus obstructing or blocking the sight can be easily retracted out of the way.

Referring now to FIG. 3 in conjunction with FIGS. 2, 8 and 9, FIG. 2 illustrates the adjustable damper assembly 40 occupying the retracted position above the sight 182 and spaced apart from the air port opening 60, the actuating rod 86 being retracted axially rightward, away from the opening 60. When the actuating rod 86 extends farther into the plenum chamber, the damper assembly 40 moves toward the air port opening, the pivot 80 sliding along the rails 162, 162. Upon reaching the position shown in FIGS. 3 and 8, the flange 116 at the distal end of the positioning cylinder 84 moves into an aperture 184 of a stop 186 affixed as by welding between the side walls 50, 51 of the plenum chamber. In that position, the bearing block 90 of the positioning cylinder 84 abuts a face 188 of the stop 186, preventing any further leftward movement (as viewed in the figures) of the bearing block 90 and cylinder 130, but allowing the end of the actuating rod, i.e., the rod end 120 and the cylindrical compression bearing 110, to pass through and emerge beyond the aperture 184 of the stop 186. Consequently, the positioning cylinder 84 telescopes and foreshortens as the actuating rod continues to drive the pivot 80 and the end bearing 100 leftward, further compressing the coil spring 124. The foreshortened cylinder 84 forms one side of the triangular truss comprising the cylinder 84, the connecting arms 88, 89 and the attachment members 68, 69, that holds the damper blade 62 in a substantially horizontal attitude when retracted; therefore, as the cylinder 84 shortens, the damper blade 62 pivots downward into the air flow of the plenum chamber, as illustrated in FIG. 9. As the damper blade 62 lowers into the airflow of the plenum chamber, the proximal end 72 of the blade and the pivot 80 move beneath a baffle plate 190, which extends between the side walls of the plenum chamber and blocks the flow of air over the top of the damper.

From the full-open position of the damper blade 62, (FIG. 8) the position of the blade 62 may be adjusted by moving the actuating rod 86 axially toward the air port opening 60 a predetermined distance, usually less than 5 centimeters, thereby lowering the damper blade 62 into the air stream to attenuate by a predetermined amount the flow of combustion air passing into the air port 30. As the distal end 64 of the damper blade 62 descends, the damper blade moves forward to keep the end positioned in the opening 60. In the presently described embodiment of the invention, the damper blade can descend until the distal end 64 thereof is disposed near the bottom of the air port opening 60, approximately 6.5 centimeters from the floor of the plenum chamber substantially diminishing but not stopping the air flow through the plenum chamber 38. The axial throw of the damper positioning mechanism 82 from the full-open position of the damper blade (FIG. 8) to the full-closed position (FIG. 9) is approximately 5 centimeters. In an alternative design, lengthening the throw of the damper positioning mechanism would result in further downward movement of the damper to shut off substantially all of the air flow through the plenum chamber.

As previously described herein, excrescent material 196 comprising hardened smelt and char material forms on the walls 22 of the firebox, particularly above the edges of the secondary air ports 30, as illustrated in FIG. 1. Referring now to FIGS. 2 and 6–9, air flow through the air port 30 is subject to attenuation by constriction of the opening from buildup of the excrescent material; therefore, the plenum chamber includes apparatus 200 mounted therein for cleaning the air port 30. The cleaning apparatus 200 includes a cleaning head 202 pivotally mounted in a retracted position above and adjacent the opening 60, as shown in FIGS. 7 and 8, and motive means 204 mounted on the faceplate 176 externally of the plenum chamber 38, the motive means coupled by way of an actuating rod 206 extending through the plenum chamber 38 to the cleaning head 202 for periodically operating the cleaning head.

Still referring to FIGS. 2, and 6–9 and particularly to FIGS. 6 and 7, the cleaning head 202 comprises a metal frame 208 constructed to fit through the opening 60 of the plenum chamber and through the air port 30. An arm 210 welded to the frame 208 depends from a cylindrical sleeve 212 mounted pivotally in a recess 214 of the plenum chamber 38, which recess extends upwardly above the opening 60. The cleaning head 202 mounts rotatably in the recess to a pivot 216 which extends through an aperture 218 in the sleeve, the pivot 216 being attached to side walls of the recess 214. A connecting rod 220 couples the arm 210 of cleaning head 202 to the actuating rod 206. The cleaning head 202 is suitably constructed of heat resistant metal such as stainless steel.

The actuating rod 206 connects slidably through a mounting sleeve and through apertures 224, 226, respectively, in the forward and rearward support plates 144, 146 to the motive means 204, which is preferably an air operated cylinder. Actuating the cylinder 204 advances the rod 206 axially toward the air port 30, which causes the connecting rod 220 to swing the cleaning head 202 by the pivot 216 from the retracted position down and forward into the air port 30. The cleaning head 202 is thus adapted to rotate from its retracted position (FIGS. 8 and 9) about the pivot 216 and sweep through the opening 60 into the air port 30 dislodging excrescent material 196 accumulated in the air port 30.

Combustion air under pressure enters the plenum chamber 38 through rearwardly disposed openings such as an opening 230 in the side wall 51 and passes through the plenum chamber to the air port opening 60. FIGS. 1, 8 and 9 show the cleaning apparatus 200 in a retracted position inside the plenum chamber 38. In such position the damper blade 62 may be lowered into position in front of the air port opening 60, thereby attenuating the flow of air through the plenum chamber. FIG. 2 shows a cleaning cycle in process wherein the damper assembly 40 is in a fully retracted position and the cleaning head 202 extends into the air port 30.

Referring to FIG. 2, the locus of movement of the cleaning head, as illustrated by the dashed semicircle 234, is in mutually interfering relation with the locus of movement of the damper blade 62, shown by the dashed line 236. Accordingly, upon initiation of a cleaning cycle, the damper blade 62 is raised from the damping position to a substantially horizontal position above the sight 182 (the position illustrated in FIG. 8), and then moved longitudinally away from the opening 60 to a retracted position (as shown in FIG. 2), which is outside the locus of movement 234 of the cleaning apparatus 200. Retraction of the damper mechanism 40 thus allows the cleaning head 202 to be actuated and moved into the opening 60 without interference from the damper blade 62.

FIGS. 8 and 9 illustrate the cleaning apparatus 200 in an at-rest or retracted position, withdrawn from the air port opening 60. The temperature inside the firebox is normally much hotter than in the plenum chamber 38 in the space occupied by the cleaning head 202, due in part to the air flow through the plenum chamber. The damper being retracted above the sight 182 of the plenum chamber allows maximum airflow through the plenum chamber during a cleaning cycle; consequently, the cleaning head is protected to a degree from the extreme temperature of the firebox, even during the brief period of use when the cleaning head protrudes into the firebox.

At timed intervals, e.g. about every ten minutes, a cleaning cycle is initiated automatically, and the damper actuator 174 moves the actuating rod 86 axially away from the opening 60 raising the damper blade 62 to the full-open position as shown in FIG. 8, and then retracting the damper assembly 40 away from the opening 60. The cylinder 204 is then actuated, swinging the cleaning head 202 into the opening 60 and the air port 30 to the position illustrated in FIG. 2. When the cleaning head 202 engages fully into the air port 30 the upper end of the cleaning head rises substantially above the upper edge of the air port and the cleaning head sweeps substantially the entire cross sectional area of the opening. The cylinder 204 is then operated in the reverse direction for retracting the cleaning head 202 from the firebox back to its at-rest position, as shown in FIGS. 8 and 9. The damper is moved from its retracted position to essentially the same position it occupied prior to initiation of the cleaning cycle, or to a new position commensurate with the air flow and velocity required through the plenum chamber following removal of material that may have been blocking the air port.

During a cleaning cycle, the operation of the mechanisms inside the plenum chamber may be viewed from the access port 178 because the damper 62 retracts above the sight 182. Between cleaning cycles, the adjustable damper assembly 40 may be retracted out of the sight 182 at any time in order to view the inside of the furnace through the opening 60, to install monitoring devices or to observe the operation or condition of the equipment inside the plenum chamber, including the functioning of the damper mechanism itself.

Referring to FIG. 8, in an alternative embodiment of the invention, wherein limited space makes full axial retraction of the damper mechanism difficult, e.g. when instrumentation is installed in the plenum chamber, a retraction stop 240 through which the actuating rod 86 passes, can be installed in the plenum chamber. Axial movement of the rod 86 away from the opening 60 retracts the damper blade 62 to the position illustrated in FIG. 8, and then moves the damper assembly 40 rightward away from the opening 60, whereupon the pivot 80 contacts the retraction stop 240 telescoping the positioning cylinder 84 and lowering the distal end 64 of the damper blade 62 into the air stream. The damper blade 62 is thus lowered below a position that would interfere with actuation of the cleaning head, but is positioned forward enough in the plenum chamber to provide for installation of sensors or other equipment in the space under the damper blade 62.

A plurality of units of the apparatus according to the present invention are ordinarily installed on a single firebox for the same boiler. The dampers may be adjusted automatically as needed by control means, not shown, responsive to furnace instrumentation to regulate the flow of combustion air entering the air ports. The operation of the cleaning apparatus may likewise be timed by timing means, not shown, to be substantially completely automatic for retracting the dampers and inserting the cleaning heads periodically for quickly cleaning the air ports during furnace operation, withdrawing the cleaning heads and returning the dampers to their previous positions.

In addition to providing improved efficiency of boiler operation, the present invention enhances operating safety, not only in eliminating the need for manual cleaning and frequent adjustment of dampers to regulate air flow and velocity to compensate for clogged air ports, but also in stabilizing the char bed which reduces the danger of hot spots and boiler tube rupture.

While the principles of the invention have now been made clear in the foregoing illustrative embodiments, there will be immediately obvious to those skilled in the art many modifications of structure, arrangement, proportions, the elements, material and components used in the practice of the invention, and otherwise, which are particularly adapted for specific environments and operating requirements without departing from those principles. The appended claims are, therefore, intended to cover and embrace any such modifications, within the limits only of the true spirit and scope of the invention.

We claim:

1. Air flow regulating apparatus, comprising:

a plenum chamber having air flowing therethrough between a first opening receiving air under pressure and a second opening expelling the air flowing through the plenum chamber;

a damper in the plenum chamber between the first and second openings;

means for mounting the damper in a retracted position spaced apart from the second opening and out of the flow of air; and actuating means for moving the retracted damper toward the second opening to a position adjacent to the second opening, the actuating means including means for positioning the damper into the flow of air adjacent to the second opening, the positioning means including means for repositioning the damper to the retracted position.

2. Apparatus regulating air flow through an air port of a firebox, said apparatus comprising:

a plenum chamber having first and second ends, a first opening in the first end of said plenum chamber and a second opening toward the second end of said plenum chamber, the second opening receiving air under pressure, the air being supplied through the first opening to the air port, the second end of said plenum chamber having an access port with a closure, through which access port a sight is provided to the first opening;

means mounted in said plenum chamber between the first and second openings for damping the flow of air through said plenum chamber to the air port;

means for mounting said damping means inside said plenum chamber in a retracted position spaced apart from the first opening and above the sight between the access port and the first opening, said mounting means including means for slidably holding said damping means whereby said damping means is movable toward the first opening, said holding means including means for pivotally holding said damping means; and actuating means for slidably moving said damping means toward the first opening, said actuating means including means for pivoting said damping means downward into the sight to a position resulting in a predetermined velocity and flow of air through said plenum chamber to the air port.

3. In a reduction furnace provided with a plurality of air ports in a wall of the furnace, a wind box supplying combustion air under pressure through the air ports to a firebox of the furnace, and a damper controlling the flow of combustion air through one of the air ports, the improvement comprising:

a plenum chamber in the wind box having a first opening into the firebox through the one air port and a second opening receiving air from the wind box, the plenum chamber including an access port with a closure in an end of the plenum chamber remote from the air port, through which access port a sight is provided through the plenum chamber to the first opening;

a mount attached inside the plenum chamber including means for holding the damper slidably in a retracted position between the first and the second openings above the sight and spaced apart from the first opening, the holding means including a pivot holding the damper pivotally cantilevered above the sight, the damper being movable about the pivot downward into the sight to regulate velocity and quantity of the air flowing through the plenum chamber to the first opening; and means for moving the damper including a damper positioning mechanism, an actuator affixed exteriorly of the plenum chamber above the access port, and an actuating rod extending into the plenum chamber from the actuator and coupled to the damper through the damper positioning mechanism, the actuating rod, upon being advanced axially into the plenum chamber, moving the damper toward the first opening, the damper remaining above the sight between the access port and the first opening until the damper reaches a position adjacent to and above the first opening, whereupon further axial advancement of the actuating rod actuates the damper positioning mechanism to pivot the damper downward to a predetermined position which damps the flow of air through the plenum chamber.

4. In a chemical reduction furnace provided with a plurality of air ports in a wall of the furnace, apparatus regulating the flow of air flow through one of the air ports, said apparatus comprising:

a plenum chamber having a first opening into the furnace through the one air port and a second opening receiving a supply of combustion air under pressure, the plenum chamber including an access port with a closure, the access port being located in an end of the plenum chamber remote from the first opening and through which access port a sight is provided through the plenum chamber to the first opening;

a damper mounted in the plenum chamber between the first opening and the second opening:

a mount attached inside the plenum chamber including means for holding the damper slidably in a retracted position between the first and the second openings, the holding means including a pivot holding a proximal end of the damper pivotally above the sight, the damper being rotatable about the pivot so that a distal end of the damper is movable downward into the sight to regulate velocity and quantity of the air flowing from the wind box through the plenum chamber to the first opening; and means for moving the damper including a damper positioning mechanism, an actuator affixed exteriorly to the plenum chamber above the access port, and an actuating rod extending into the plenum chamber from the actuator and coupled to the damper by way of the damper positioning mechanism, the actuating rod being adapted for axial movement wherein the actuation rod, upon being advanced axially into the plenum chamber, moves the damper toward the first opening, the damper remaining above the sight between the access port and the first opening until the distal end of the damper reaches a position adjacent to and above the first opening, whereupon further axial advancement of the actuating rod toward the first opening actuates the damper positioning mechanism to pivot the damper downward to a predetermined position which damps the flow of air through the plenum chamber.

5. The apparatus according to claim 4, wherein the damper positioning mechanism comprises:

spring means for holding the damper above the sight when the damper is in the retracted position, the spring means being compressed to force the distal end of the damper downward into the air flowing through the plenum chamber, the compressed spring means providing force to raise the distal end of the damper above the sight when the damper is retracted.

6. The apparatus according to claim 4, wherein the damper positioning mechanism comprises:

a telescoping cylinder coaxial with the actuating rod, the cylinder having a first segment abutting a first stop on the actuating rod, the first stop preventing movement of the first segment along the actuating rod away from a distal end of the actuating rod, and a telescoping segment axially slidable along the actuating rod toward the first segment from a second stop, the second stop being disposed on the actuating rod toward the distal end of the actuating rod from the first stop, the second stop preventing axial movement of the telescoping segment toward the distal end of the actuating rod beyond the second stop;

a coil spring compressed inside the cylinder and surrounding the actuating rod, the coil spring urging the first and second segments of the telescoping cylinder apart against the stops;

an actuating arm connected between the telescoping segment of the cylinder and the damper, the compressed coil spring having sufficient force to hold the distal end of the damper above the sight of the plenum chamber; and a third stop affixed to the plenum chamber and disposed in a position such that the distal end of the actuating rod reaches the third stop concurrently with the distal end of the damper reaching the first opening, the third stop having an aperture therethrough through which the distal end of the actuating rod passes, the third stop engaging the telescoping segment of the cylinder and further compressing the coil spring inside the cylinder as the actuating rod continues to advance axially through the aperture in the third stop, whereby the actuating arm forces the distal end of the damper downward.

7. The apparatus according to claim 1 wherein said positioning means includes means for positioning the damper into the flow of air in said plenum chamber when said damper is spaced apart from the second opening.

* * * * *

UNITED STATES PATENT AND TRADEMARK OFFICE

CERTIFICATE OF CORRECTION

PATENT NO. : 4,846,080

DATED : July 11, 1989

INVENTOR(S) : THOMAS W. ROSS et al

It is certified that error appears in the above-identified patent and that said Letters Patent is hereby corrected as shown below:

Column 1, line 32, "n" should be --in--.

Column 5, line 31, "in" should be --is--.

Signed and Sealed this

First Day of February, 1994

Bruce Lehman

*Attest:*

BRUCE LEHMAN

*Attesting Officer*

*Commissioner of Patents and Trademarks*